US007059375B2

(12) United States Patent
Pederson et al.

(10) Patent No.: US 7,059,375 B2
(45) Date of Patent: Jun. 13, 2006

(54) METHOD AND DEVICE FOR WALLPAPER BORDER APPLICATION

(76) Inventors: Robert Pederson, 191 Wild Ave., Staten Island, NY (US) 10314; James Cicconi, 79 Bentley St., Staten Island, NY (US) 10307

( * ) Notice: Subject to any disclaimer, the term of this patent is extended or adjusted under 35 U.S.C. 154(b) by 783 days.

(21) Appl. No.: 10/666,934

(22) Filed: Jan. 30, 2002

(65) Prior Publication Data

US 2004/0163753 A1 Aug. 26, 2004

(51) Int. Cl.
*B44C 7/00* (2006.01)
*B44C 7/02* (2006.01)
*B44C 7/06* (2006.01)

(52) U.S. Cl. ..... 156/574; 156/577; 156/579; 242/588.1

(58) Field of Classification Search ..... 156/71, 156/574, 579, 577, 575; 118/501; 242/588.1, 242/590, 597, 597.7, 588, 588.2, 597.8
See application file for complete search history.

(56) References Cited

U.S. PATENT DOCUMENTS 4,834,312 A * 5/1989 Riemenschneider, III ..... 242/588.2
5,135,179 A * 8/1992 Morano ..... 242/423.1
5,280,869 A * 1/1994 Ricci ..... 242/588.2
5,328,543 A * 7/1994 Campagna ..... 156/574
5,403,430 A * 4/1995 Araujo et al. ..... 156/523
5,478,432 A * 12/1995 Vester ..... 156/574
5,573,630 A * 11/1996 Edney et al. ..... 156/577
5,743,485 A * 4/1998 Martorelli et al. ..... 242/597.7
6,073,671 A * 6/2000 Chapman ..... 156/574
6,464,164 B1 * 10/2002 Cox et al. ..... 242/588.2
D503,603 S * 4/2005 Pederson et al. ..... D8/71
6,955,321 B1 * 10/2005 Lewis ..... 242/588
2003/0145954 A1 * 8/2003 James ..... 156/577

* cited by examiner

*Primary Examiner*—Sue A. Purvis
(74) *Attorney, Agent, or Firm*—Mary A. Whiting, Esq.

(57) ABSTRACT

A device for applying wallpaper borders to walls and ceilings, which is anchored in place by conventional pin means pushed through holes in the surface of the device, for hands free maneuverability. The device is preferably composed of plastic which is waterproof easily cleaned, safe, and durable. The device is either transparent or made of mesh material, so the user can see when the wallpaper border is nearing its end without having to stop the application process. Handles of varying lengths adjust to wall and ceiling measurements, while the device's cup's length can vary to adjust to different widths of wallpaper border. A cap with a notched rim can also be fitted on the device to secure the wallpaper border inside the device. The device is easy enough for a novice to use and also creates an error free finish suitable for professional use.

9 Claims, 4 Drawing Sheets

2C
12
13
14
2
2C
6
4
7
7
2B
2B
8
20
3

8
20
19
10
3

4
10
9
20
8
19
3
12
13
14
4

FIG. 3B
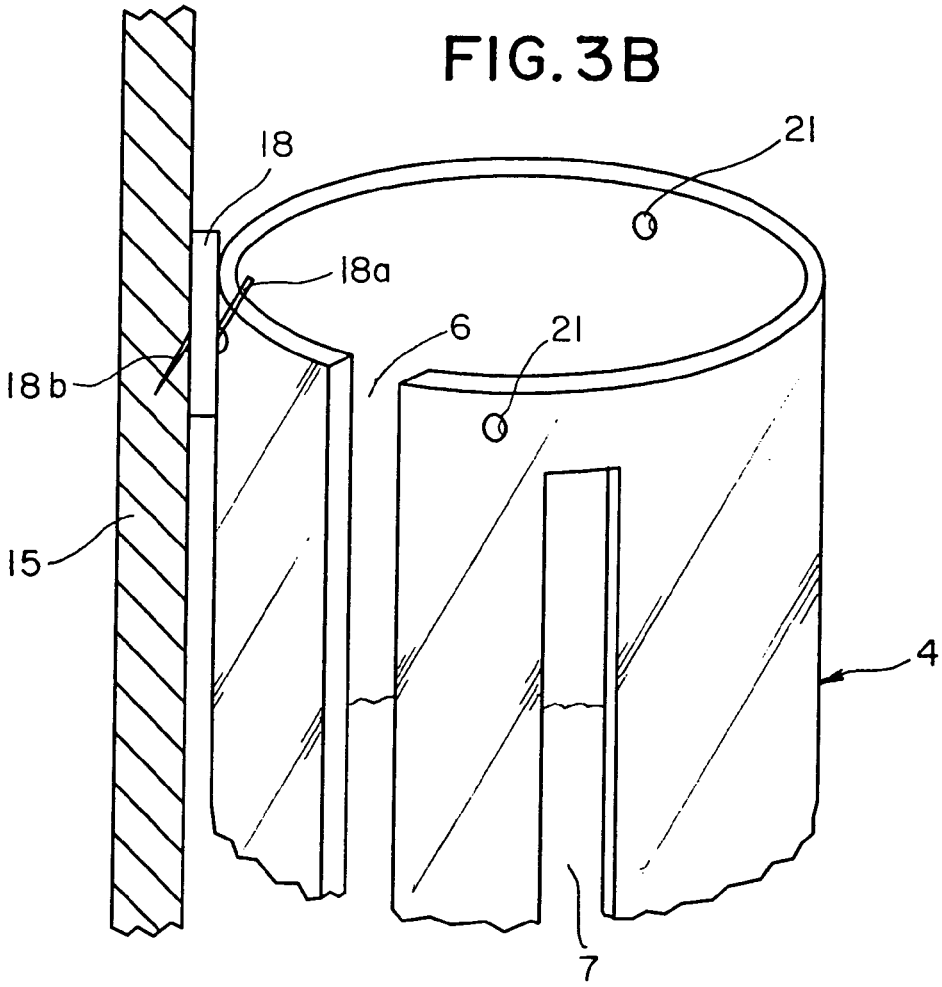
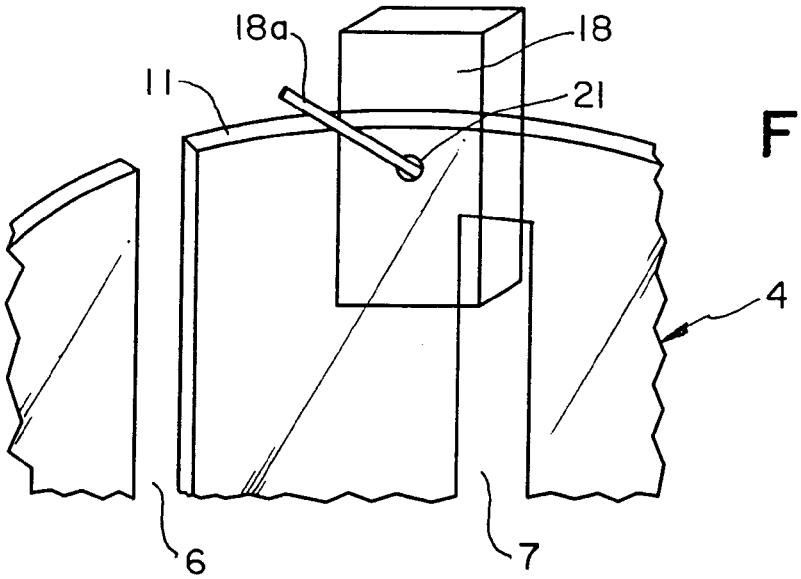
FIG. 3A

METHOD AND DEVICE FOR WALLPAPER BORDER APPLICATION

BACKGROUND

1. Field of Invention

The present invention relates to a method and device for applying wallpaper borders to a flat receiving surface, such as walls or ceilings, which device can be attached to the receiving surface hands free to aid the user by eliminating the need for a second user or additional equipment to hold the wallpaper border in place and not damage the wall or ceiling while the user changes its position, or performs other functions.

2. Description of the Prior Art

There are several prior art devices disclose various tools for applying wallpaper borders, which include:

| Inventor | U.S. Pat. No. | Date |
|---|---|---|
| Johnson | U.S. Pat. No. 6,173,749B | Jan. 16, 2001 |
| Zane | U.S. Pat. No. 5,775,633 | Jul. 7, 1998 |
| Edney et. al. | U.S. Pat. No. 5,573,630 | Nov. 12, 1996 |
| Vester | U.S. Pat. No. 5,478,432 | Dec. 26, 1995 |
| Mazzola et. al. | U.S. Pat. No. 5,453,152 | Sep. 26, 1995 |
| Aranjo et al | U.S. Pat. No. 5,403,430 | Apr. 4, 1995 |
| Burch | U.S. Pat. No. 5,403,432 | Apr. 4, 1995 |
| Campagna | U.S. Pat. No. 5,328,543 | Jul. 12, 1994 |

Prior art devices with anchoring devices as disclosed in Zane U.S. Pat. No. 5,775,633, and Burch, U.S. Pat. No. 5,403,432, created holes that damaged the wall or the border, which necessitate repair. Other prior art devices utilizing long poles as handles, such as Campagna U.S. Pat. No. 5,328,543 and Johnson U.S. Pat. No. 6,713,749B, can not be utilized for ceiling application. Neither can prior art devices utilizing trays, such as Johnson U.S. Pat. No. 6,713,749B, Aranjo CL al. U.S. Pat. No. 5,403,430, and Mazzola et al. U.S. Pat. No. 5,453,152, be utilized for ceiling application. Prior art devices also employ a cup shaped containers with slots through which the wallpaper border is applied to a wall, such as Edney et. al., U.S. Pat. No. 5,573,630, Campagna U.S. Pat. No. 5,328,543, and Vester, U.S. Pat. No. 5,478,432, which can not be anchored to the wall or ceiling for hands free employment and which need the aid of an additional user.

OBJECTS AND ADVANTAGES

Accordingly, besides the distinctions from the prior art stated above, several objects and advantages of the present invention are:

To provide for a device wherein the apparatus is contained in one easily transportable unit;

To provide for a device wherein the need for numerous sized devices is eliminated as the device can be used for any width or standard length of wallpaper border;

To provide for a device, wherein the wallpaper border can be applied vertically, as well as horizontally to walls or ceilings;

To provide for a device that can be anchored to walls or ceilings for hands free application of wallpaper borders;

To provide for a device preferably made of plastic, wherein the device is easily cleaned;

To provide for a device preferably made of plastic, wherein the device is relatively inexpensive to manufacture;

To provide for a device preferably made of plastic, wherein the device is transparent or made of plastic mesh, so the user can see when the wallpaper border role is near its end, and ready for a refill without having to stop application and look into the device;

To provide for a device preferably made of plastic, wherein the device is waterproof so as not to degrade under the wet conditions, and To provide for a device preferably made of plastic, wherein the device is durable, not easily broken or fractured, and therefore safe.

BRIEF DESCRIPTION OF THE DRAWINGS

FIG. 3*a* is a perspective view showing the cylindrical cup portion (fragmented view), anchored to the wall by the dual sided push pin.

FIG. 3*b* is a cross-sectional view of the receiving surface (wall), showing the device (fragmented view) anchored to the wall.

Figure 1:
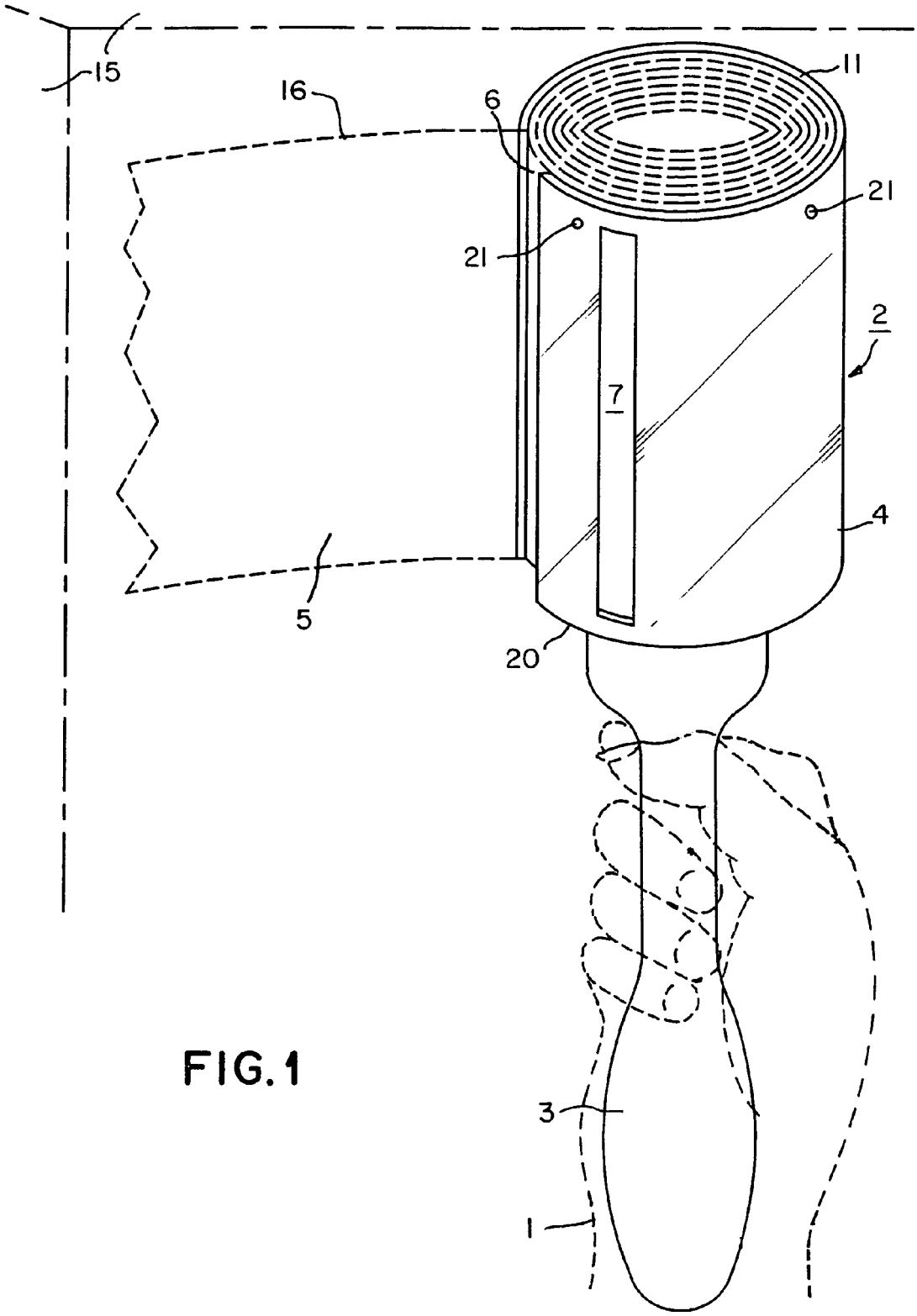
FIG. 1. is a perspective side view of the present invention showing the wallpaper border being pulled through the cup length longitudinal slot while being applied to the receiving surface (wall). The wallpaper border and user's hand are shown by dotted line for illustrative purposes only, since they are not part of the invention.

| Reference Numbers in the Drawings | |
|---|---|
| 1. | User |
| 2. | Device |
| 3. | Handle portion |
| 4. | Cylindrical cup portion |
| 5. | Wallpaper border |
| 6. | Longitudinal slot |
| 7. | Side slit |
| 8. | Centrally located male threaded bolt of handle portion |
| 9. | Centrally located female threaded bore of cylindrical cup portion |
| 10. | Circular planar surface of cylindrical cup portion's bottom |
| 11. | Top circular edge of cylindrical cup portion |
| 12. | Cap portion |
| 13. | Rim |
| 14. | Notch |
| 15. | Receiving surface |
| 16. | Top edge of border |
| 17. | Linear edge formed by intersection of horizontal and vertical receiving surfaces |
| 18. | Dual sided push pin |
| 18a. | Upwardly slanting needle of the dual sided push pin |
| 18b. | Downwardly slanting needle of the dual sided push pin |
| 19. | Circular planar end handle portion |

-continued

| Reference Numbers in the Drawings | |
|---|---|
| 20. | Circular bottom edge of cylindrical cup portion |
| 21. | Plurality of Pin holes |

SUMMARY OF THE INVENTION

This invention relates generally to a device for applying wallpaper borders of different widths and lengths using the same tool, whereby the user can anchor the device to a flat receiving surface (either a wall or ceiling), in order to have hands free movement to position ladders, mix glue or perform other functions, while applying the wallpaper border. The device is comprised of a cylindrical cup portion with a cup length longitudinal slot open at it top end, through which the wallpaper border is pulled through, and plurality of slits cut into the surface of the cylindrical cup portion for water access, and a handle portion.

The tool is preferably comprised of transparent solid plastic or plastic mesh material, in order to make the end of the wallpaper border roll visible to the user, so that the user does not have to stop and look inside the device to determine if the wallpaper border needs to be changed or is coming to an end. Plastic is preferable since it is safe, won't fracture, is easily cleaned and holds it shape when wet. A water resistant page of instructions is also included with the device.

Prior art devices disclose tools and kits for applying wallpaper or wallpaper borders. These devices are differentiated from the present invention, in that the prior art devices do not use pins or anchors that do not damage the wall or wallpaper. Using the present invention, any hole in the wall or ceiling (receiving surface), is covered by the wallpaper border, so no extra steps are needed to repair left behind holes in the receiving surface.

The preferred embodiment of the invention is comprised of molded plastic, with a cylindrical cup portion that can accommodate different sized widths and lengths of standard wallpaper borders. The standard range of a wallpaper border width is between 4 to 12 inches, and range of length is between 6 to 12 feet. The longitudinal slot is of a preferred range from 4–12 inches long, which accommodates the wallpaper border's width. The longitudinal slot is sufficiently wide enough (¼ inch) for the wallpaper border to be easily unrolled and pulled through, so as to be applied to the wall or ceiling. Prior art devices do not accommodate such a wide range of widths and lengths.

An alternative embodiment of the invention have handles of varying lengths to accommodate the user's height requirements. This may be a range from 6 inches to 2 feet in length. In the preferred embodiment of the invention, the handle threadedly attaches to the base of the cylindrical cup portion by a centrally positioned threaded male bolt on the handle's top which screws into a centrally positioned threaded female bore on the cylindrical cup portion's base. Alternatively, the male bolt of the handle could be friction fit into the female bore of the cup portion's base.

The device is simple to use and applies the wallpaper border in a straight line, either vertically or horizontally, with clean edges and without air-bubbles. Therefore, professionals as well as laypersons will benefit from its use.

A plurality of side slits symmetrically cut through the cylindrical cup portion's surface allow for water to seep through the device to evenly wet the dry glued back of the wallpaper border in order to create paste. These slots also allow for even flow of water through the device to reduce water logging and degradation of the wetted wallpaper border during use. These side slits can either be longitudinally or concentrically located on the cylindrical cup portion's surface.

A notched rimmed cap can be securely friction fit to the top circular edge of the cylindrical cup portion in order to hold the wallpaper border in the device. A notch on the rim aligns with the open edge of the longitudinal slot, so when the cap is attached to the device, the wallpaper border's edge won't scrape against the cap's rim and be damaged during application In the preferable embodiment of the invention, the device is anchored to the receiving surface by a dual sided push pin. Conventional pin devices can also be used. An upwardly slanting needle anchors the device to the outwardly facing surface of the dual sided push pin. A downwardly slanting needle attaches the inwardly facing surface of the dual sided push pin to the receiving surface. When the device is made of plastic mesh material, the upwardly slanting needle can be pushed through the pin holes or the mesh material to anchor the device to the receiving surface. After the wallpaper border is applied to the receiving surface by the present invention, the hole created by the push pin in the receiving surface, is covered with the wallpaper border, leaving no detectable holes in the wall or the ceiling that would be unsightly and need repair.

DESCRIPTION OF THE PREFERRED EMBODIMENT OF THE INVENTION

Referring to the drawings by numerals of reference, this invention relates generally to a device comprising a molded body comprising a cylindrical cup portion with a plurality of side slits and pin holes are cut into the cylindrical cup portion's surface, as well as a body length longitudinal slot open at one end, and a handle portion for applying wallpaper borders. A cap with a notched rim can also be attached to the device.

FIG. 1, illustrates a user 1 with the device 2 aligned parallel to the receiving surface 15, (which can either be a wall or a ceiling), so that the wallpaper border 5, which is rolled inside the device 2, can be unrolled through the longitudinal slot 6, and applied to the receiving surface 15. The longitudinal slot 6 is preferably ¼ inch wide. The device 2 can be used to apply wallpaper border 5 of varying widths and lengths, by matching the length of the cylindrical cup portion 4 to the width of the wallpaper border 5.

As shown in FIG. 1, the top edge 11 of the cylindrical cup portion 4 is placed into the linear edge 17, formed by the horizontal and vertical receiving surfaces interest (where the wall meets the ceiling), in order for the wallpaper border 5 to be applied aligned with the straight line formed by the meeting of the planar ceiling and wall surfaces. The device 2 can also be aligned to apply the wallpaper border 5 any distance from this linear edge 17, on the wall or on the ceiling.

Figures 2, 2A, 2B, 2C:
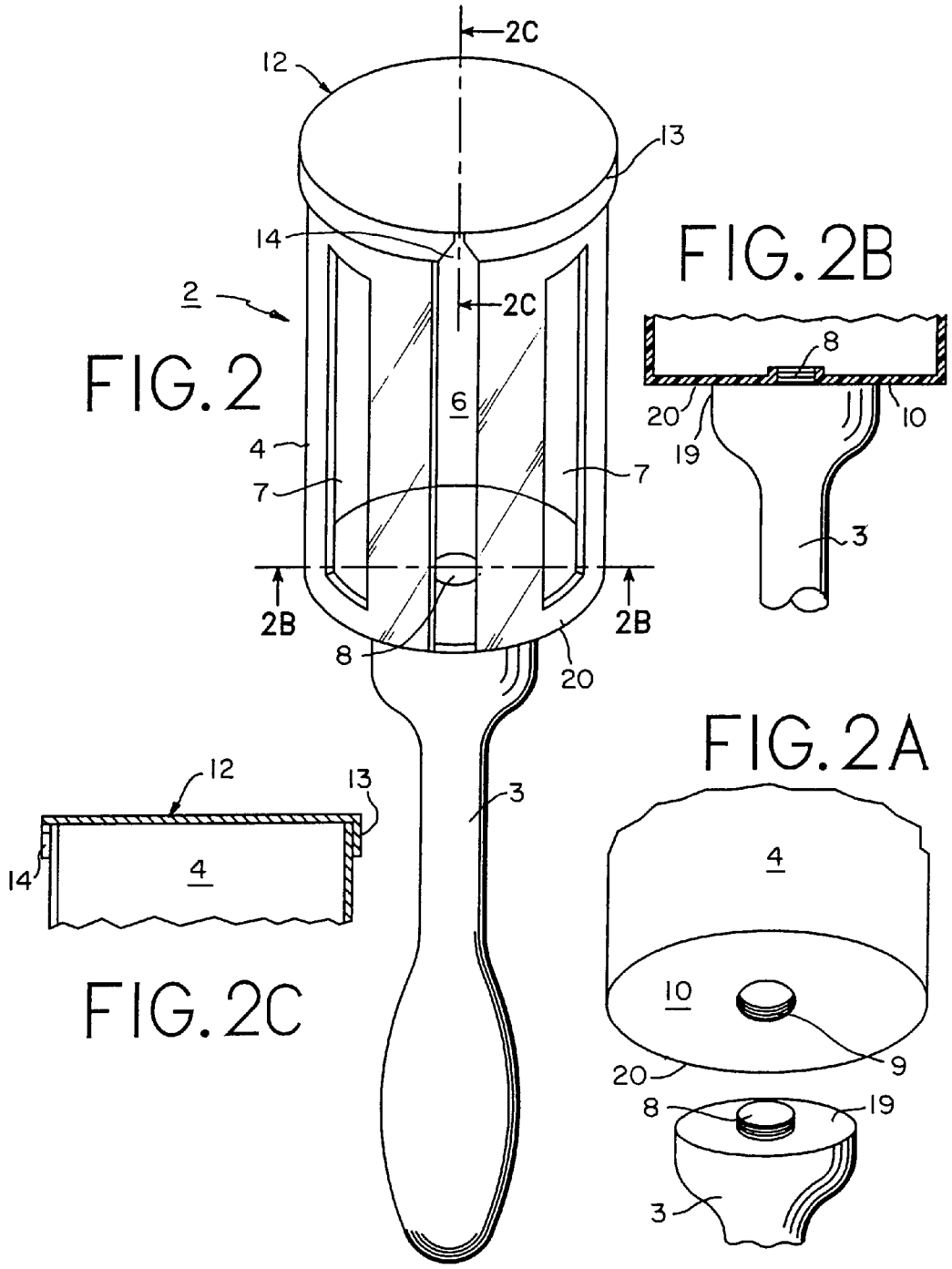
FIG. 2. is a perspective frontal view of the present invention, showing a capped cylindrical cup portion with the cap's notch portion aligned with the longitudinal slot.
FIG. 2*a* is a detailed expanded view showing the handle portion threadedly attached to the cylindrical cup portion's circular planar bottom surface.
FIG. 2*b* is a cross-sectional view along line a-a' showing the male threaded bolt of the handle portion threaded though the female threaded bore of the cylindrical cup portion's bottom circular planar surface.
FIG. 2*c* is a cross-sectional view along line b-b' showing the notched cap.
Figures 3, 4:
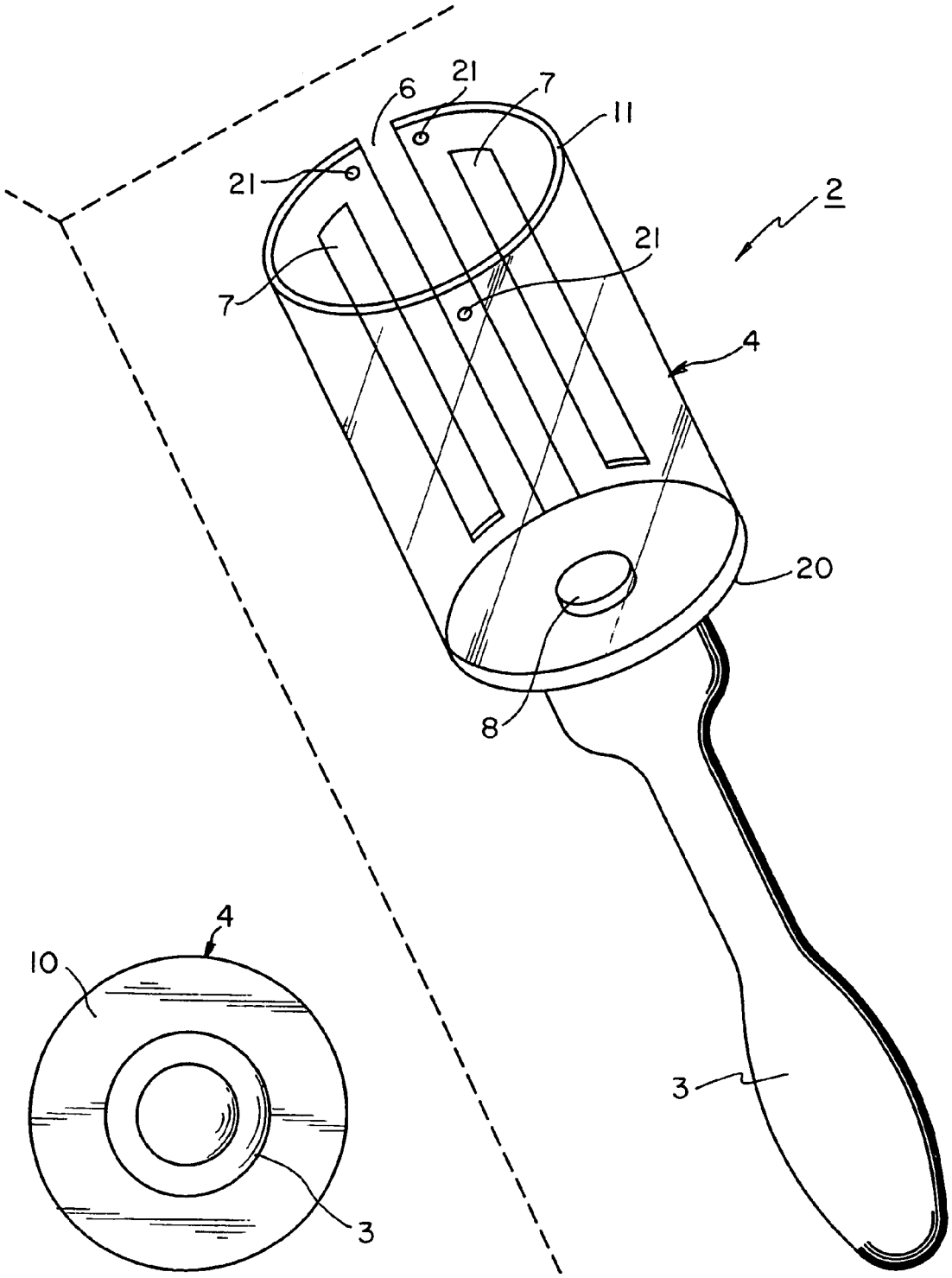
FIG. 3. is a perspective side view of the present invention, showing the cylindrical cup portion anchored to the wall by the dual sided push pin.
FIG. 4 is a planar bottom view of the present invention, showing the handle portion in relation to the circular planar surface of the cylindrical cup portion's bottom.

Shown in FIG. 1, FIG. 2 and FIG. 3, a plurality of side slits 7 cut into the cylindrical cup portion's 4 surface, allow water to soak evenly into the cylindrical cup portion 4 and onto the roll of wallpaper border 5, in order to create a paste on the back of the wallpaper boarder 5. When the device 2 is made of plastic mesh material, water soaks evenly through to the wallpaper border 5. The slots and mesh material also allow for even flow of water through the device to reduce water logging and degradation of the wetted wallpaper border during use.

As shown in FIGS. 1 and 3, once the user 1 has drawn the wallpaper border 5 to maximum arm's length, push pin's 18 upwardly slanting needle 18*a*, is stuck through one of the plurality of pin holes 21 aligned closest to the receiving surface 15, and the downwardly slanting needle 18*b* is anchored to the receiving surface 15, to attach the device 2 to the receiving surface 15. Once the device 2 is so anchored to the receiving surface 15, the user 1 has hands free movement in order to realign its ladder, move further along the wall or ceiling, and start the process over again to continue applying the wallpaper border 5 to the receiving surface 15.

The device 2 is preferably made of transparent solid plastic or plastic mesh material in order for the user 1 to see through the device to determine is the wallpaper border 5 is nearing an end. This allows for the user 1 to determine when the roll of wallpaper border 5 will need to be changed without having to stop the process and look into the device. This saves significant time and energy.

As shown in FIG. 1, FIG. 2 and FIG. 3, the preferred embodiment of the device 2 is a single piece of molded plastic, comprising a cylindrical cup portion 4, and a handle portion 3.

As shown in detail in FIG. 2*a*, the device can also be comprised of a removable handle portion 3 with a centrally located threaded male bolt 8 at its flattened top end 19, which screws into a centrally located threaded female bore 9 in the bottom surface 10 of cylindrical cup portion 4. Handle portions 3 can be of various lengths to accommodate the user's needs.

FIG. 4 shows the central location of the handle portion's 3 attachment to the bottom surface 10 of the cylindrical cup portion 4, with circular edge 20.

FIG. 2*b* shows the cross-sectional view along line a-a' of the handle portion 3 threadedly attached to the bottom surface 10 of the cylindrical cup portion 3.

As shown in FIG. 2, a flat circular cap portion 12 with a rim 13 can be friction fit over the outside surface of the cylindrical clip portion's 4 top circular edge 11. The rim 13 has a notch 14 which aligns with the open edge of the single longitudinal slot 6 of the cylindrical cup portion 4, to stop the edge 16 of the wallpaper border 5 from scraping against the rim 13 and tearing during use. FIG. 2*c* shows a cross-sectional view along line b-b', showing the notch 14 in the rim portion 13 of the cap 12."

We claim:

1. A device for applying a wetted wallpaper border roll with a glued back and an unglued front to a receiving surface, comprising a: cylindrical cup portion with a circular top edge, and a circular bottom planar surface with a circular bottom edge, and a handle portion, said cylindrical cup portion further comprising a longitudinal slot open at said circular top edge and closed at said circular bottom edge, a plurality of side slits symmetrically aligned along said cylindrical cup portion, and a plurality of pin holes symmetrically aligned adjacent to said circular top edge of said cylindrical cup portion, wherein, with said wetted wallpaper border roll in said device with said glued back portion facing said receiving surface, and while simultaneously holding said handle portion, said user then aligns said device along a desired horizontal and vertical measurement of said receiving surface and swipes said device along a desired length of said receiving surface, thereby pulling said wallpaper border through said longitudinal slot of said cylindrical cup portion, and simultaneously adhering said glued back of said wallpaper border to said receiving surface, and further, anchoring said device to said receiving surface by conventional anchoring means, for hands free movement during application of said wallpaper border until all said wallpaper border is spent.

2. Device according to claim 1, wherein said cylindrical cup portion further comprises a flat circular cap portion with a rim portion, further comprising a notch, wherein said notched rim portion is aligned with said open end of said longitudinal slot, when said flat circular cap portion is friction fitted over said circular top edge of said cylindrical cup portion, in order to secure said wallpaper border into said device and to pull said wallpaper border freely through said longitudinal slot to avoid rubbing and tearing said wallpaper border on said rim portion.

3. Device according to claim 1, wherein said plurality of side slits are aligned longitudinally along said cylindrical cup portion.

4. Device, according to claim 1, wherein said plurality of side slits are aligned concentrically around said cylindrical cup portion.

5. Device, according to claim 1, wherein said device is comprised of a one solid molded piece of waterproof plastic material, to enhance strength and durability.

6. Device, according to claim 1, wherein said device is comprised of transparent waterproof plastic material, which enhances the viewing of the position of said wallpaper border inside said device in order to observe when said wallpaper border is nearing its end and needs to be replaced.

7. Device, according to claim 1, wherein said device is comprised of plastic mesh material, which enhances the viewing of the position of said wallpaper border inside said device in order to observe when said wallpaper border is nearing its end and needs to be replaced, which increases the sufficiently of even water flow through said device to enhance the even wetting of said wallpaper border and reduce water logging of the wetted wallpaper border, and wherein said anchoring means is attached to said device through openings in said mesh material.

8. Device, according to claim 1, wherein said anchoring means is attached to said device through one of a plurality of pin holes symmetrically aligned adjacent to said top edge of said cylindrical cup portion.

9. Device, according to claim 1, wherein said handle portion of said device further comprises a flat circular planar top portion with a centrally located threaded male bolt means which threadedly attaches to a centrally located threaded female bore means on said circular bottom planar surface of said cylindrical cup portion.

* * * * *